US006769949B2

(12) United States Patent
Kim et al.

(10) Patent No.: US 6,769,949 B2
(45) **Date of Patent: *Aug. 3, 2004**

(54) POWER-DRIVEN ORNITHOPTER

(75) Inventors: Seung-Woo Kim, Daejeon (KR); Ii-Hyung Jang, Daejeon (KR); Myung-Hwan Kim, Daejeon (KR); Jong-Seon Kim, Daejeon (KR)

(73) Assignee: Neuros Co., LTD, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/184,338

(22) Filed: Jun. 26, 2002

(65) Prior Publication Data

US 2003/0096553 A1 May 22, 2003

(30) Foreign Application Priority Data

Nov. 16, 2001 (KR) ..... 2001-71488

(51) Int. Cl.[7] ..... A63H 27/00
(52) U.S. Cl. ..... 446/35; 244/11; 244/22; 244/72
(58) Field of Search ..... 446/34–37, 236; 244/11, 22, 28, 72

(56) References Cited

U.S. PATENT DOCUMENTS

| | | | | | |
|---|---|---|---|---|---|
| 781,104 | A | * | 1/1905 | Slin | 446/35 |
| 1,758,178 | A | * | 5/1930 | Slinn | 446/35 |
| 1,880,586 | A | * | 10/1932 | Tiling | 244/74 |
| 2,182,406 | A | * | 12/1939 | Ogsbury et al. | 446/35 |
| 2,321,977 | A | * | 6/1943 | Boatright | 446/35 |
| 2,504,567 | A | * | 4/1950 | Morgan | 446/35 |
| 2,985,407 | A | | 5/1961 | Foster | |
| 3,857,194 | A | * | 12/1974 | Guttman | 446/36 |
| 4,139,171 | A | | 2/1979 | Harris | 244/22 |
| 4,155,195 | A | | 5/1979 | Leigh-Hunt | 46/74 R |
| 4,195,438 | A | | 4/1980 | Dale | 46/74 R |
| 4,712,749 | A | | 12/1987 | Fox | 244/22 |

(List continued on next page.)

OTHER PUBLICATIONS

DeLaurier, James D., An Ornithopter Wing Design, Canadian Aeronautics and Space Journal, Mar. 1994.
Jones, K.D and Platzer, M.F., An Experimental and numerical Investigation of Flapping–Wing Propulsion, 37$^{th}$ Aerospace Sciences Meeting and Exhibit, Jan. 1999.
Kirkpatick, Sean J., Scale Effects of the Stresses and Safety Factors in the Wing Bones of Birds and Bats, J.exp. Biol. 190, pp. 195–215, 1994.
DeLaurier, J.D and Harris, J.M, A Study of Mechanical Flapping–Wing Flight, The Aeronautical Journal of the Royal Aeronautical Society, Oct. 1993.

*Primary Examiner*—Derris H. Banks
*Assistant Examiner*—Bena B. Miller
(74) *Attorney, Agent, or Firm*—Graybeal Jackson Haley LLP

(57) ABSTRACT

An ornithopter with an airframe structure that is lightweight, simple and stable and can generate sufficient lift and thrust. The ornithopter comprises a body, a main wing attached to an upper portion of a front section of the body, and a tail wing attached to a rear section of the body. The ornithopter further comprises a power source and a power transmission mechanism installed within a housing of the body. The main wing includes a wing frame composed of a plurality of frame rods and a skin attached to the wing frame for forming an outline of the main wing. The wing frame of the main wing is supported by a support means exposed to the outside at the upper portion of the front section of the body. The power transmission mechanism includes a gear train for adjusting the rotational motion of the power source at a proper speed and transferring it to the main wing, and connecting rods for converting the rotational motion into a swing motion of the main wing. Flight time of the ornithopter can be prolonged considering its weight and the power source can be easily manipulated.

27 Claims, 10 Drawing Sheets

U.S. PATENT DOCUMENTS

| | | | | |
|---|---|---|---|---|
| 4,729,748 | A | | 3/1988 | Van Ruymbeke |
| 4,749,149 | A | | 6/1988 | Gruich ..... 244/22 |
| 5,163,861 | A | * | 11/1992 | Van Ruymbeke ..... 446/35 |
| 5,899,408 | A | | 5/1999 | Bowers ..... 244/11 |
| 6,082,671 | A | | 7/2000 | Michelson ..... 244/72 |
| 6,152,799 | A | | 11/2000 | Arriola ..... 446/330 |
| 6,227,483 | B1 | | 5/2001 | Therriault ..... 244/20 |

* cited by examiner

POWER-DRIVEN ORNITHOPTER

BACKGROUND OF THE INVENTION

1. Field of the Invention

The present invention relates to an ornithopter, and more specifically, to a power-driven ornithopter using an electric motor as a power source.

2. Description of the Prior Art

An ornithopter that mimics flight of an insect or bird corresponds to a very primitive model but has been hardly put to practical use. An aircraft model that has been put to practical use is largely divided only into a fixed wing aircraft and a rotary wing aircraft. The reason why the ornithopter has not been put to practical use is that analyses of a lift and a thrust to be generated by flapping of its main wings is very complicated as compared with those of the fixed wing aircraft and the rotary wing aircraft, and thus, it is difficult to design an ornithopter model ensuring a flight stability in view of flight dynamics and it is complex to design an actuating mechanism for performing the flapping.

However, the ornithopter still arouses persons' curiosities due to its nature-friendly shape. There have been continuous attempts to develop the ornithopter as a leisure or toy aircraft that requires a relatively lower flight stability.

Recent attempts to develop the ornithopter will be described below.

U.S. Pat. No. 4,729,748 (Mar. 8, 1988) issued to Gerard Van Ruymbeke discloses a flying toy. The flying toy includes a body, main wings and tail wings that have appearances similar to those of a body, wings and a tail of a bird; an elastic band; a wind-up assembly for twisting the elastic band; an activation assembly for activating flapping of the main wings, which is similar to flapping of the wing of the bird, by transferring force released when the twisted elastic band is untwisted; and a latching assembly for latching or locking the main wings when the elastic band is twisted. U.S. Pat. No. 5,163,861 (Nov. 17, 1992) issued to Gerard Van Ruymbeke discloses a wing-operated flying toy and a process for automatically locking the wings at the end of a flight. The flying toy of the '861 patent is constructed such that a locking device, which is similar to the latching assembly of the toy of the '748 patent, locks the main wings even when the toy is flown while the elastic band is untwisted.

U.S. Pat. No. 4,749,149 (Jul. 7, 1988) issued to Peter Gruich discloses an ornithopter-type vehicle and methods of constructing and utilizing the same. The ornithopter-type vehicle is designed as an aircraft which is large enough to load persons thereinto. The ornithopter-type vehicle has main wings and a horizontal tail attached to its body in a manner similar to the fixed wing aircraft. An up motion of the flapping of the main wings that move between their higher and lower positions is established by elastic restoring force. A down motion of the flapping is established by power transferred from a power source through a hydraulic circuit. The ornithopter-type vehicle simultaneously obtains both the lift and thrust by the down motion of the main wings in a downward and rearward direction rather than a vertically downward direction from the higher position. The ornithopter-type vehicle is constructed such that its flight attitude is maintained in such a manner that a user controls the motion of the main wings and the position of the horizontal tail through operating levers.

U.S. Pat. No. 5,899,408 (May 4, 1999) issued to Kenneth R. Bowers, Jr. discloses an ornithopter. The ornithopter also has a main wing and a horizontal tail attached to its body in a manner similar to the fixed wing aircraft and employs a gasoline engine as a power source. The ornithopter is provided with flaps formed at the bottoms of the main wing so as to increase the lift obtainable from the flapping of the main wing.

As described in the aforementioned '408 patent, the reason why the ornithopter has not been yet put to practical use regardless of whether it is a toy ornithopter or a manned ornithopter is that the lift obtainable from the flapping of the main wings is small and an activating mechanism and a power source capable of generating the flapping of the main wings cannot provide sufficient power and are too complicated and heavy.

SUMMARY OF THE INVENTION

The present invention is conceived to solve the problems in the prior art. An object of the present invention is to provide an ornithopter with an airframe structure that is lightweight, simple and stable and can generate sufficient lift and thrust.

Another object of the present invention is to provide an ornithopter having a lightweight, simple and durable power transmission mechanism and a simply-operable power source capable of ensuring longer flight time with respect to its weight.

An ornithopter according to the present invention for achieving the objects comprises a body, a main wing attached to an upper portion of a front section of the body, and a tail wing attached to a rear section of the body. A power source and a power transmission mechanism are installed within a housing of the body. The main wing includes a wing frame composed of a plurality of frame rods, and a skin attached to the wing frame for forming an outline of the main wing. The wing frame of the main wing is supported by a support means that is exposed to the outside at the upper portion of the front section of the body. The power transmission mechanism includes a gear train for adjusting the rotational motion of the electric motor at a proper speed and transferring it to the main wing, and connecting rods for converting the rotational motion into a swing motion of the main wing.

Preferably, the body includes a keel, which is made of a lightweight and rigid unitary panel, for supporting components contained in the body. The housing for enclosing the keel and the contained components is composed of two members, left and right halves.

The housing of the body is preferably constructed such that an extra space is formed between a front end of the housing and a front end of the power transmission mechanism to extend from the front end of an electric motor and the power transmission mechanism, which are mounted at a front end of the keel panel, to a position forward spaced apart therefrom. It is preferred that the extra space be filled with a shock absorbing material.

Preferably, each front frame rod extends along a front edge of the main wing from a position near a central axis of the body to a tip of the main wing and is initially formed in the shape of a straight line. Each rear frame rod extends from a position near an intersection of the central axis of the body and a rear edge of the main wing, and is connected to the front frame rod near an end of the tip of the main wing, i.e. a distal end of the front frame rod. Respective traverse frame rods extend from the front frame rod to the rear edge of the main wing.

Herein, if it is not specifically described, it should be understood that all the terms for designating the directions are used to refer to directions based on the ground in a state where the ornithopter according to the present invention is placed on the ground with a normal attitude.

BRIEF DESCRIPTION OF THE DRAWINGS

The above and other features, advantages and aspects of the present invention will become more apparent when reading the following description of preferred embodiments of the present invention given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
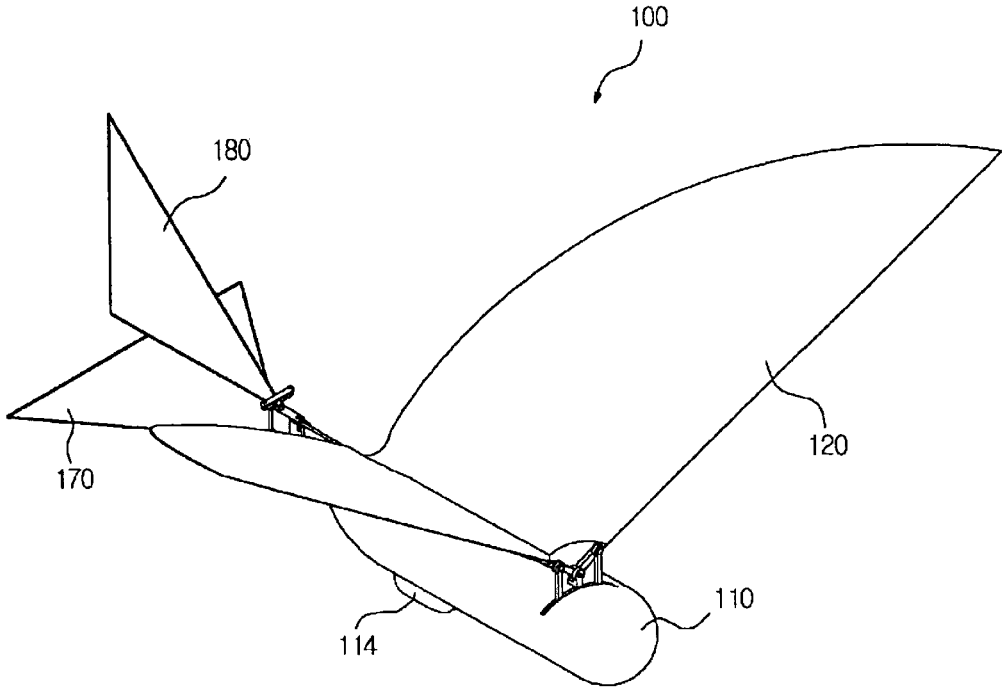
FIG. 1 is a perspective view of an ornithopter according to a preferred embodiment of the present invention.

As shown in FIG. 1, an ornithopter 100 of the present invention comprises a body 110, a main wing 120 attached to an upper portion of a front section of the body 110, and a tail wing 170, 180 attached to a rear section of the body 110.

In the ornithopter 100 according to this embodiment, an outline of the body 110 is formed in the shape of a bird or an insect or in various streamlined designs. A housing 111, 112 forming the outline is made of resin materials or composite materials such as carbon composite materials or boron composite materials, which are lightweight and durable.

A power source and a power transmission mechanism 230, which will be explained in detail later, are installed within the housing 111, 112 of the body 110.

Figure 4:
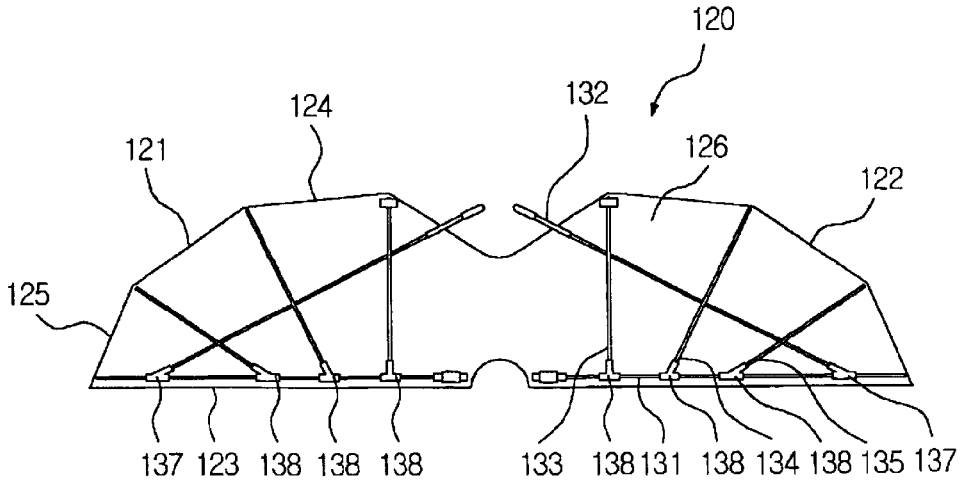
FIG. 4 is a deployment view of a main wing of the ornithopter shown in FIG. 1.

As shown in FIG. 4, the main wing 120 of the ornithopter 100 according to the present embodiment is composed of left and right main wings 121, 122 which are formed integrally with each other and symmetric to each other with respect to a central axis of the body 110. An outer appearance of the main wing 120 takes the shape similar to a deployed shape of wings of a bird. That is, a front edge 123 of the main wing 120 is formed in the shape of a straight line, and a rear edge 124 and tips 125 are composed of smoothly connected curves.

The main wing 120 is composed of a skin 126 for forming a surface of the main wing and frame rods for maintaining a shape of the main wing. The frame rods are made of rigid and tough alloy materials or carbon materials capable of maintaining their initial shapes.

Each of the left and right main wings 121, 122 according to this embodiment includes a single front frame rod 131, a single rear frame rod 132, and three traverse frame rods 133, 134 and 135.

The front frame rod 131 extends along the front edge 123 of the main wing 120 from a position near a central axis of the body 110 to a tip 125 of the main wing 120 and is initially formed in the shape of a straight line.

Each rear frame rod 132 extends from a position near an intersection of the central axis of the body 110 and the rear edge 124 of the main wing 120 and is connected through a connector 137 to the front frame rod 131 near an end of the tip 125 of the main wing 120, i.e. a distal end of the front frame rod 131. The connector 137 is formed by injection molding resin materials or the like, and includes a hollow cylindrical stem through which the front frame rod 131 passes and a branch formed in the middle of the stem to extend therefrom at the same angle as is formed between the rear frame rod 132 and the front frame rod 131. The branch is provided with a bore into which a front end of the rear frame rod 132 is fitted. A proximal end of the rear frame rod 132, i.e. an end of the rear frame rod 132 positioned near the central axis of the body 110, can be located a position further spaced apart from the rear edge 124 of the main wing 120 that is formed by the skin 126. However, it should not extend beyond the central axis of the body 110.

The three traverse frame rods 133, 134 and 135 extend from the front frame rod 131 to the rear edge 124 of the main wing 120. The traverse frame rods 133, 134 and 135 are also connected through connectors 138 to the front frame rod 131. Each of the connectors 138 can be formed by injection molding the resin materials in the same manner as the aforementioned connector 137, and takes the shape similar to that of the connector 137 except for a different angle formed between a stem of the connector 138 and a branch of the connector 138 provided with a bore into which the traverse frame rod 133, 134 or 135 is fitted and extending from the stem. A front end of the first traverse frame rod 133, i.e. an end of the first traverse frame rod 133 positioned at the front edge 123 of the main wing 120, is located at a position spaced apart by 1/10 to 3/10 of the full length of the front frame rod 131 from a proximal end of the front frame rod 131, i.e. an end of the front frame rod 131 positioned near the central axis of the body 110. A front end of the second traverse frame rod 134 is located at a position spaced apart by 3/10 to 5/10 of the full length of the front frame rod 131 from the proximal end of the front frame rod 131. A front end of the third traverse frame rod 135 is located at a position spaced apart by 5/10 to 8/10 of the full length of the front frame rod 131 from the proximal end of the front frame rod 131. The traverse frame rods 133, 134 and 135 are disposed in such a manner that they are further spaced apart from the central axis of the body 110 when proceeding from their front ends to their rear ends. As for angles formed between the central axis of the body 110 and the lengths of the respective traverse fame rods 133, 134 and 135, the angle is about 10 to 30° in case of the first traverse frame rod 133, about 30 to 50° in case of the second traverse frame rod 134, and about 50 to 70° in case of the third traverse frame rod 135, respectively.

The skin 126 of the main wing 120 can be made of cloth or resin sheet which is lightweight, lacks elasticity, has moisture resistance and is durable. The skin 126 can be formed in a one-fold configuration such that it is attached only to one surface of a wing frame composed of the plurality of the frame rods, or formed in a twofold configuration such that it is attached to both surfaces of the wing frame. In the case where the skin 126 is formed in the twofold configuration, two sheets of the skin 126 can be come into close contact with each other with the wing frame interposed therebetween to form a substantially one-fold configuration.

The front and rear frame rods 131, 132 of the left main wing 121 are separated from those of the right main wing 122, and the left main wing 121 is connected to the right main wing 122 by means of only the flexible skin 126. Thus, the left and right main wings 121, 122 can move freely with respect to each other in a direction in which they are folded or deployed.

The tail wing of the ornithopter 100 according to the embodiment is composed of a single horizontal tail 170 and a single vertical tail 180 disposed at an upper side of the horizontal tail 170.

Figure 5:
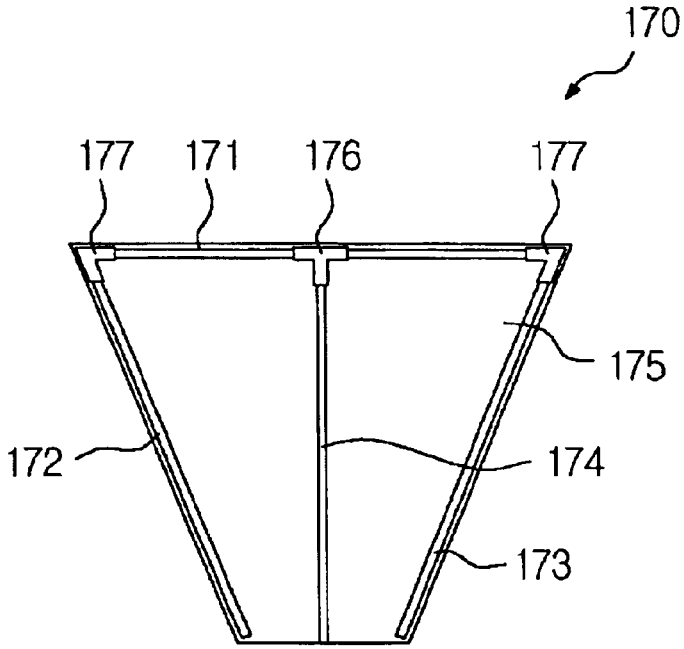
FIG. 5 is a plan view of a horizontal tail of the ornithopter shown in FIG. 1.

According to the embodiment, as shown in FIG. 5, a wing frame of the horizontal tail 170 generally takes the shape of an isosceles triangle composed of outer frame rods 171, 172 and 173 for forming an outline of the horizontal tail and an inner reinforcement frame rod 174. Connectors 176 similar to the connectors 137, 138 previously explained in connection with the main wing are used for connections of the inner frame rod 174 and the outer frame rods 171, 172 and 173 of the horizontal tail 170. However, connectors 177 for use in corners where two outer frame rods meet each other may be formed in an elbow shape. A skin 175 of the horizontal tail 170 can be made of cloth or resin sheet which is lightweight, lacks elasticity, has moisture resistance and is durable. A skin 175 can also be formed in a one-fold configuration such that it is attached only to one surface of the wing frame composed of the plurality of the frame rods, or formed in a twofold configuration such that it is attached to both surfaces of the wing frame. In the case where the skin 175 is formed in the twofold configuration, two sheets of the skin 175 can be come into close contact with each other with the wing frame interposed therebetween to form a substantially one-fold configuration.

As shown in FIG. 5, the horizontal tail 170 is constructed to be symmetric in a state where its width is increased in a backward direction along the central axis of the body 110. Further, the horizontal tail is attached to the rear section of the body 110 at an apex of the horizontal tail 170.

Figure 6:
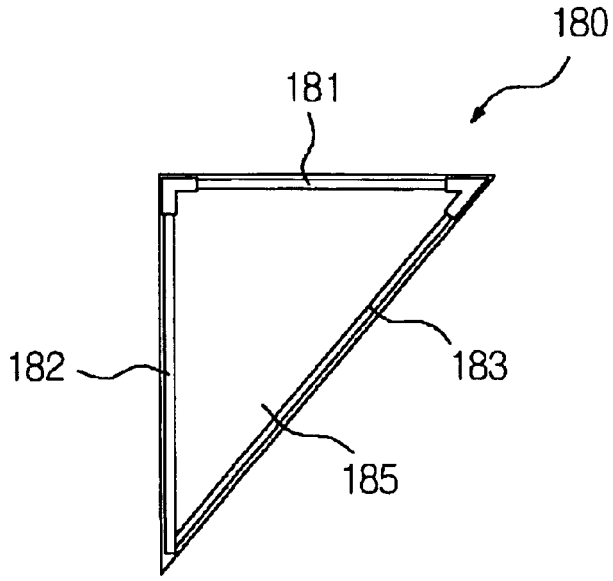
FIG. 6 is a side view of a vertical tail of the ornithopter shown in FIG. 1.

As shown in FIG. 6, a wing frame of the vertical tail 180 takes the shape of a triangle composed of outer frame rods 181, 182 and 183. A skin 185 of the vertical tail 180 can also be made of cloth or resin sheet which is lightweight, lacks elasticity, and is high waterproof and durable. The skin 185 can be formed in a one-fold configuration such that it is attached only to one surface of the wing frame composed of the plurality of the frame rods, or formed in a twofold configuration such that it is attached to both surfaces of the wing frame. In the case where the skin 185 is formed in the twofold configuration, two sheets of the skin 185 can be come into close contact with each other with the wing frame interposed therebetween to form a substantially one-fold configuration.

The vertical tail 180 constructed as such is disposed perpendicularly onto an upper surface of the horizontal tail 170 and attached to the rear section of the body 110 at an apex of the vertical tail 180, as shown in FIG. 1.

In this embodiment, the frame rods of the horizontal and vertical tails 170, 180 are made of the same material as those of the main wing 120.

Figure 2:
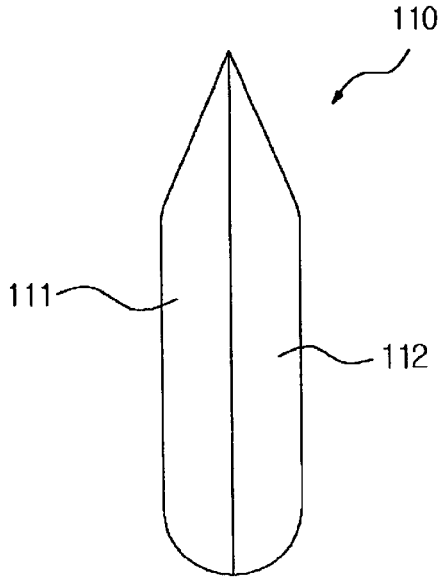
FIG. 2 is a plan view illustrating a housing of a body of the ornithopter shown in FIG. 1.
Figure 3:
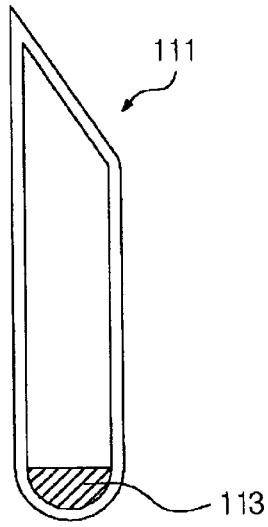
FIG. 3 is a side view illustrating the interior of a left half of the housing shown in FIG. 2.

As shown in FIGS. 2 and 3, the housing 111, 112 of the body 110 according to the embodiment comprises two members, i.e. left and right halves 111, 112 which are divided by a vertical plane including the central axis of the body 110. The left and right halves 111, 112 are assembled into the housing by means of a pinching method using recesses and protrusions which is one of known assembly methods employed in assembly of a housing composed of two members.

However, since such assembly using the pinching method is not robust, it is likely that the housing 111, 112 is disassembled when the ornithopter collides against an external object during its flight or landing. To prevent this disassembly, engagement portions of the left and right halves 111, 112 are provided with sawteeth, and bonding portions to which bonding tapes called as "Velcro fastener" have been applied are provided at and around the sawteeth. Upon coupling of the left and right halves 111, 112, the halves may be assembled by applying an additional adhesive tape onto the bonding portions of the bonding tapes at and around the sawteeth.

Figure 7:
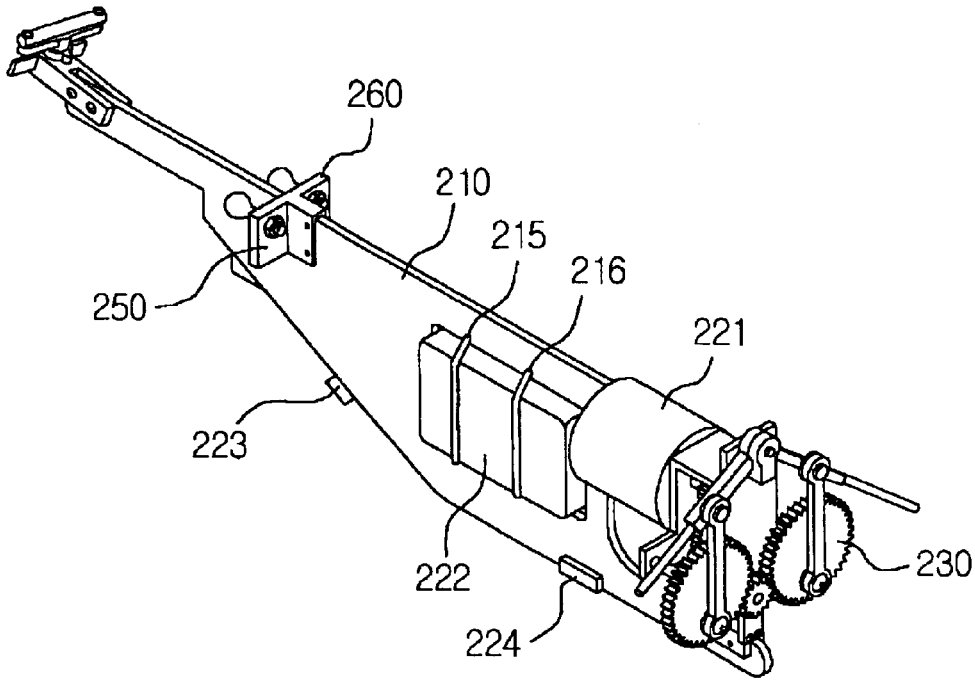
FIG. 7 is a perspective view illustrating components installed within the body of the ornithopter shown in FIG. 1.

FIG. 7 shows the interior of the body 110 with the housing 111, 112 removed therefrom.

Figure 8:
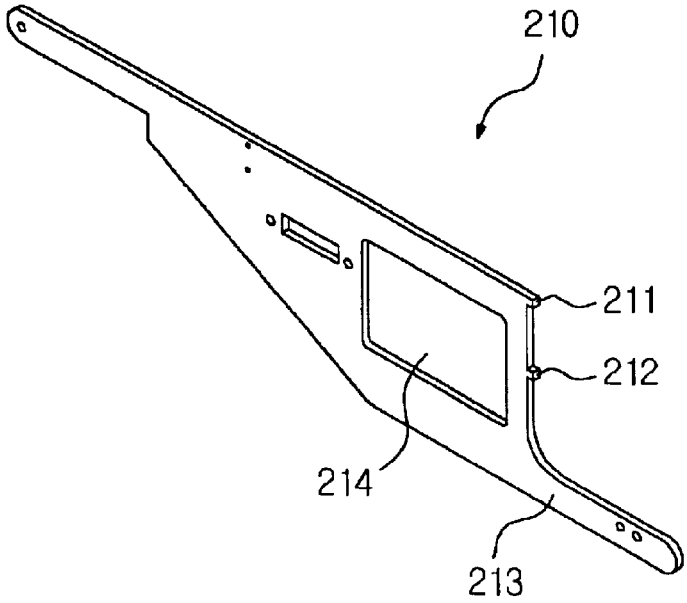
FIG. 8 is a perspective view illustrating a keel panel of the body of the ornithopter shown in FIG. 1.

A keel of the body 110 of the ornithopter 100 according to the embodiment of the present invention is formed with a lightweight and rigid unitary panel, as shown in FIG. 8. As shown in FIGS. 7 and 8, such a keel panel 210 is disposed along the central axis of the body 110. The keel panel 210 has a length extending from the vicinity of the front section to the vicinity of the rear section of the body 110 and a width extending from an upper end to a lower end of the body 110.

As shown in FIGS. 7 and 8, an electric motor 221 is mounted at an upper front end of the keel panel 210, and a power transmission mechanism 230 is mounted in front of the electric motor 221. To this end, protrusions 211, 212 for supporting the electric motor 221 are formed at the upper front end of the keel panel 210, and a lower front end of the keel panel 210 extends further forward as compared with the upper front end thereof to form a support 213 for supporting the power transmission mechanism 230. As described in detail later, the electric motor 221 is assembled integrally with the power transmission mechanism 230. The motor supporting protrusions 211, 212 are inserted into holes formed at a rear surface of the electric motor 221 with play in such a degree that the protrusions can easily escape from the holes so as to prevent the electric motor 221 from rocking laterally. The power transmission mechanism 230 is fixed to the support 213 by means of screws. In the case where the electric motor 221 and the power transmission mechanism 230 are mounted on the keel panel 210 in such a manner, if the support 213 is broken due to any impact applied to the keel panel 210, the power transmission mechanism 230, or the like, the motor supporting protrusions 211, 212 escape from the holes of the electric motor 221 and then the electric motor 221 and the power transmission mechanism 230 are easily separated from the keel panel 210. Thus, the risk of breakage of or damage to the electric motor 221 or the power transmission mechanism 230 can be reduced.

A battery mounting hole 214 is formed at a central portion of the keel panel 210. A battery 222 is inserted into the battery mounting hole 214 and then firmly fastened by clamps 215, 216. Further, holders 250, 260 for holding the rear frame rods 132 of the left and right main wings 121, 122, respectively, are mounted at an upper end of the keel panel 210. A support 270 for supporting the tail wing 170, 180 is mounted at a rear end of the keel panel 210.

Figure 9:
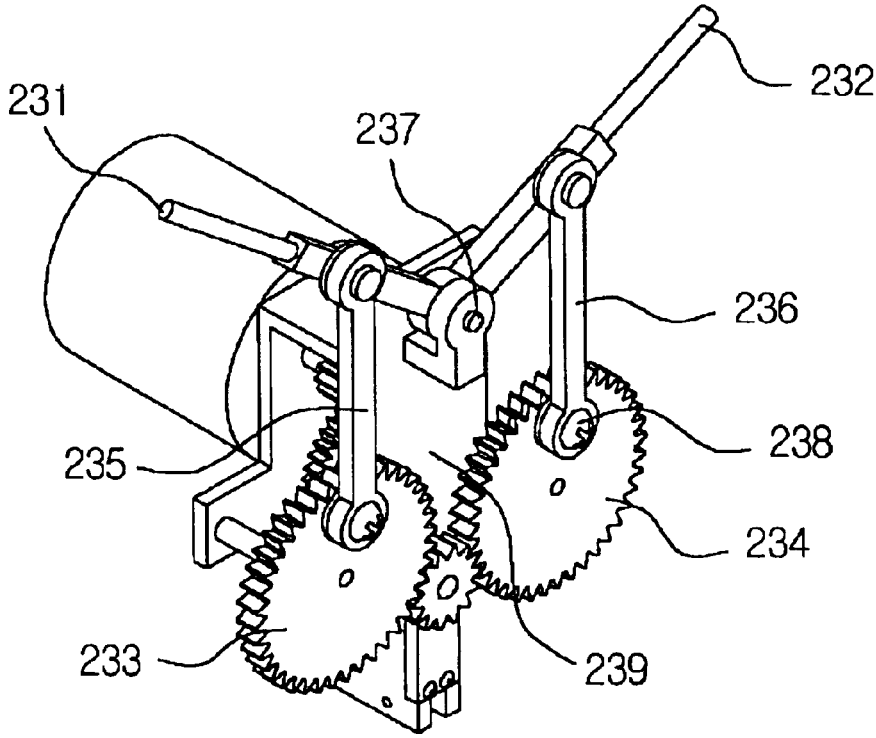
FIG. 9 is a perspective view illustrating an assembly of an electric motor and a power transmission mechanism of the ornithopter shown in FIG. 1.
Figure 10:
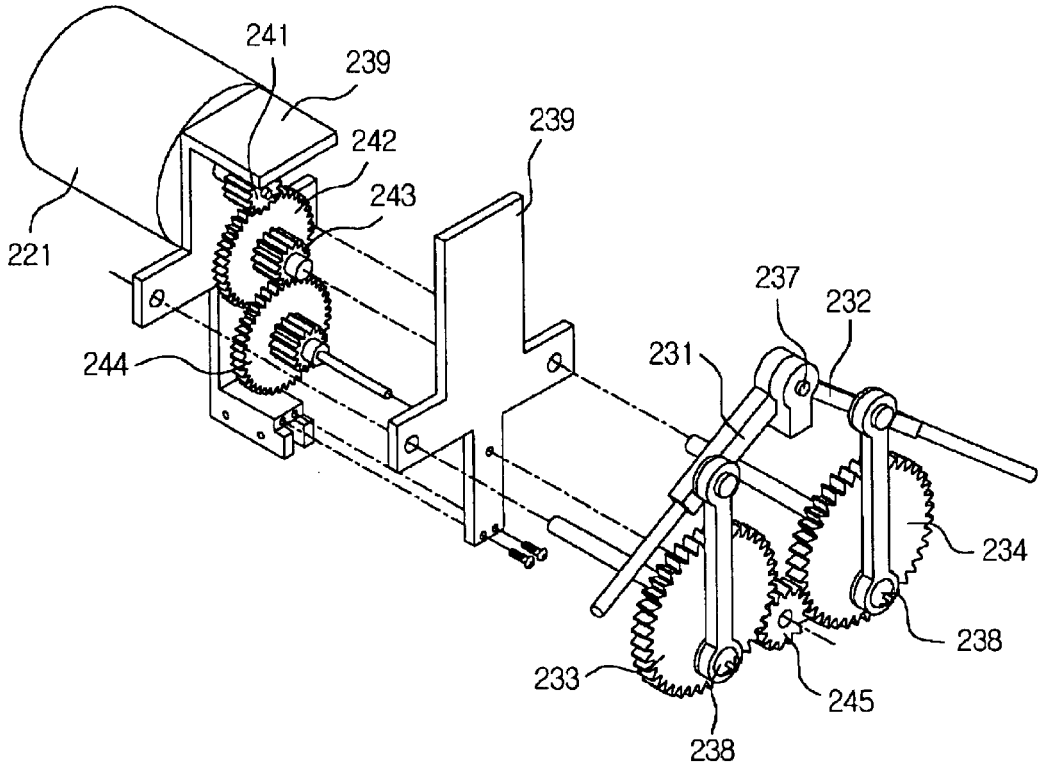
FIG. 10 is an exploded perspective view illustrating of the assembly of the electric motor and the power transmission mechanism shown in FIG. 9.

FIGS. 9 and 10 are detailed view illustrating the electric motor 221 and the power transmission mechanism 230. The power transmission mechanism 230 comprises a pair of arms 231, 232 which are connected to the front frame rods 131 of the left and right main wings 121, 122, respectively; a pair of driven wheels 233, 234 which are rotated by means of the rotational motion of the electric motor 221 transmitted through one or more intermediate power transmission geared-wheels; connecting rods 235, 236 which connect the driven wheels 233, 234 and the arms 231, 232, respectively, and swing the arms 231, 232 up and down within a predetermined angular range on a pivotal point, respectively, as the driven wheels 233, 234 are rotated; a reduction gear train which is engaged with a rotating shaft of the electric motor 221 and the pair of driven wheels 233, 234, and reduces and simultaneously transfers the rotational motion of the electric motor 221 to the pair of driven wheels 233, 234; and a stand 239 for fixing and holding the reduction gear train.

Figure 11:
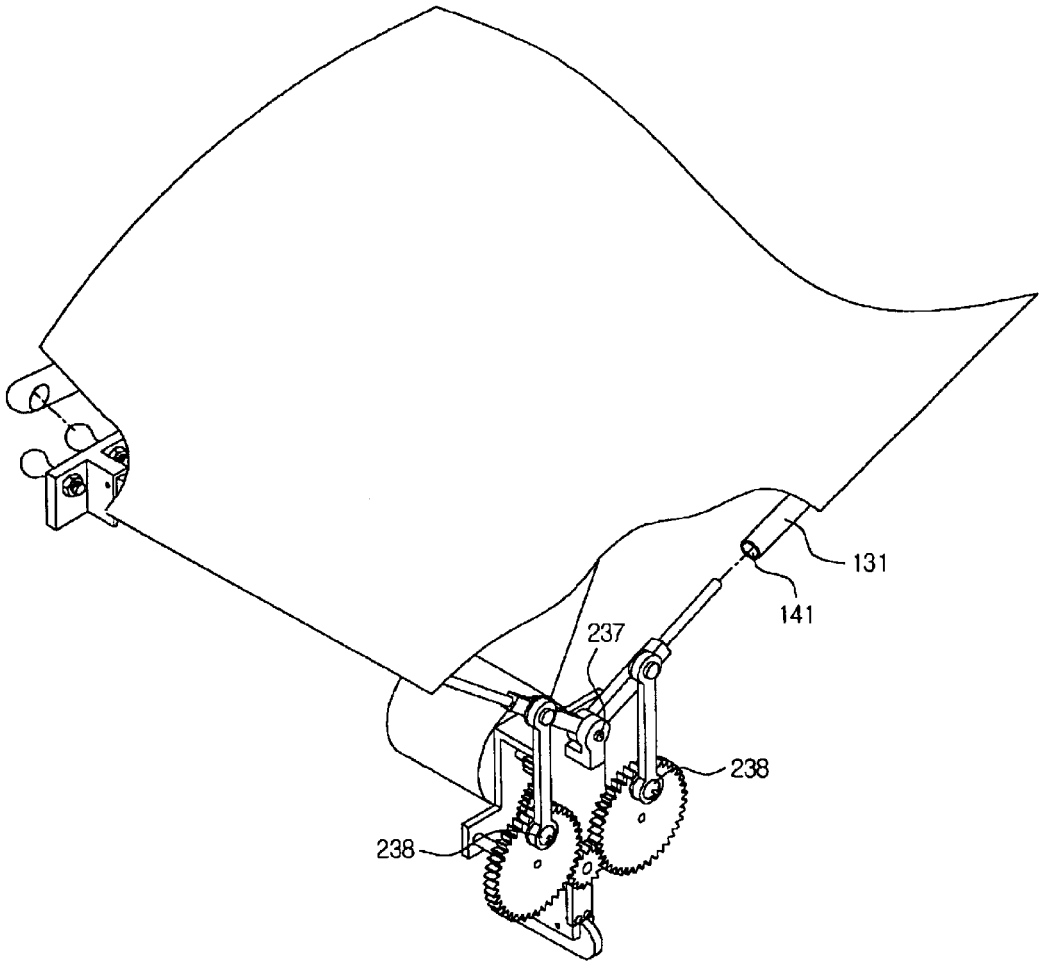
FIG. 11 is an explanatory view illustrating connection of a proximal end of a front frame rod of the main wing to free ends of arms of the power transmission mechanism shown in FIG. 9.

Each of the pair of arms 231, 232 of the power transmission mechanism 230 has a free end and a supported end pivotably supported by a supporting pole 237 which protrudes from an upper portion of the stand 239. At this time, an axial core of the supporting pole 237 becomes the pivotal point of the arms 231, 232. Meanwhile, as shown in FIG. 11, an axial bore 141 is formed at the proximal end of the front frame rod 131 to extend from the proximal end by a predetermined depth along an axial core of the front frame rod 131. Further, the free ends of the arms 231, 232 of the power transmission mechanism 230 are machined to have such a diameter that the free ends can be press-fitted into the axial bores 141 of the respective front frame rods 131. When the electric motor 221 is driven in a state where the free ends of the arms 231, 232 are fitted into the axial bores of the respective front frame rods 131, the left driven wheel 233 and the left connecting rod 235 cause the left arm 231 to swing and thence the left main wing 121 to flap, while the right driven wheel 234 and the right connecting rod 236 cause the right arm 232 to swing and thence the right main wing 122 to flap.

Each of the connecting rods 235, 236 has a first end supported by a supporting pole protruding from a position of the arm spaced apart from the pivotal point of the arms 231, 232, and a second end supported by another supporting pole 238 protruding from a position near the circumference of the driven wheel 233 or 234. The first and second ends are supported pivotably on the respective supporting poles.

The supporting pole 238 on the left driven wheel 233 and the supporting pole 238 on the right driven wheel 234 are installed to be always in the same phase, i.e. equal positions. In other words, if the supporting pole 238 on the left driven wheel 233 is at an uppermost position, the Supporting pole 238 on the right driven wheel 234 is also at the uppermost position. If the Supporting pole 238 on the left driven wheel 233 is at a lowermost position, the supporting pole 238 on the right driven wheel 234 is also at the lowermost position. As the supporting pole 238 on the left driven wheel 233 moves from the uppermost position to the lowermost position, the supporting pole 238 on the right driven wheel 234 also moves from the uppermost position to the lowermost position. As the supporting pole 238 on the left driven wheel 233 moves from the lowermost position to the uppermost position, the supporting pole 238 on the right driven wheel 234 also moves from the lowermost position to the uppermost position. Accordingly, if the left arm 231 is at a largest positive angle of the main wing, the right arm 232 is also at the largest positive angle. If the left arm 231 is at a largest negative angle of the main wing, the right arm 232 is also at the largest negative angle. As the left arm 231 moves from the largest positive angle to the largest negative angle, the right arm 232 also moves from the largest positive angle to the largest negative angle. As the left arm 231 moves from the largest negative angle to the largest positive angle, the right arm 232 also moves from the largest negative angle to the largest positive angle. Consequently, the left and right main wings 121, 122 connected to the left and right aims 231, 232, respectively, simultaneously flap up and down.

As shown in FIG. 10, the reduction gear train according to the embodiment comprises the aforementioned pair of driven wheels 233, 234 and five additional intermediate power transmission geared-wheels. A first power transmission geared-wheel 241 is fitted over the rotating shaft of the electric motor 221 to rotate at the same speed as the rotating shaft and is formed with a first external gear having G1 teeth. A second power transmission geared-wheel 242 is formed with a second external gear having G2 teeth in engagement with the first external gear. A third power transmission geared-wheel 243 is placed coaxially with the second power transmission geared-wheel 242 to rotate at the same speed as the second power transmission geared-wheel and is formed with a third external gear having G3 teeth. The second and third power transmission geared-wheels 242, 243 may be formed integrally with each other. A fourth power transmission geared-wheel 244 is formed with a fourth external gear having G4 teeth in engagement with the third external gear. A fifth power transmission geared-wheel 245 is connected coaxially with the fourth power transmission geared-wheel 244 to rotate at the same speed as the fourth power transmission geared-wheel and is formed with a fifth external gear having G5 teeth. The circumferences of the pair of driven wheels 233, 234 connected to the aforementioned left and right connecting rods 235, 236, respectively, are formed with teeth so that the driven wheels 233, 234 become sixth and seventh external gears having G6 and G7 teeth, respectively. G6 is identical with G7. The sixth and seventh external gears are engaged with the fifth external gear.

The rotational motion of the electric motor 221 through the reduction gear train will be briefly described hereinafter. If the rotating shaft of the electric motor 221 rotates in the clockwise direction, the first external gear also rotates in the clockwise direction at the same speed as the rotating shaft, the second external gear rotates in the counterclockwise direction at a speed reduced by G1/G2 from the speed of the first external gear, the third external gear rotates in the counterclockwise direction at the same speed as the second external gear, the fourth external gear rotates in the clockwise direction at a speed reduced by G3/G4 from the speed of the third external gear, the fifth external gear rotates in the clockwise direction at the same speed as the fourth external gear, and the sixth and seventh external gears rotate in the counterclockwise direction at a speed reduced by G5/G6 (=G5/G7) from the speed of the fifth external gear. Therefore, the sixth and seventh external gears rotate in the direction opposite to that of the rotating shaft at the speed reduced by the proper ratio (G1 G3 G5/G2 G5 G6) from the rotational speed of the rotating shaft of the electric motor 221.

As shown in FIG. 10, the stand 239 of the power transmission mechanism 230 has two sidewalls. The first to fourth power transmission geared-wheels 241 to 244 are interposed between and supported by the tow sidewalls; the fifth power transmission geared-wheel, the pair of driven wheels 233, 234 and the pair of arms 231, 232 are Supported by a first sidewall of the stand on an outer surface thereof; and a housing of the electric motor 221 is fixed to an outer surface of a second sidewall of the stand 239.

Figure 12:
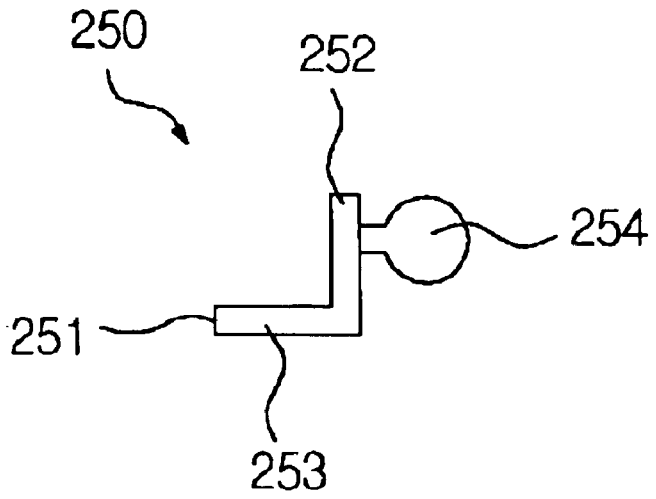
FIG. 12 is a side view illustrating a rear frame rod supporting holder mounted on the keel panel of the ornithopter shown in FIG. 1.

As shown in FIG. 7, the rear frame rod supporting holders 250, 260 are installed on the upper end of the keel panel 210. The left and right holders 250, 260 are symmetric to each other and Support the relevant rear frame rods 132 of the left and right main wings 121, 122, respectively. As shown in FIG. 12, each of the holders 250, 260 has a mount 250 with a L-shaped cross-section, and a holding ball 254 protruding from a first leg 252 of the mount 251. In a state where a second leg 253 of the mount 251 is fixed to a side surface of the keel panel in the vicinity of the upper end of the keel panel 210, the holding ball 254 extends rearward from the first leg 252 that protrudes perpendicularly from the side surface of the keel panel 210.

Figure 13:
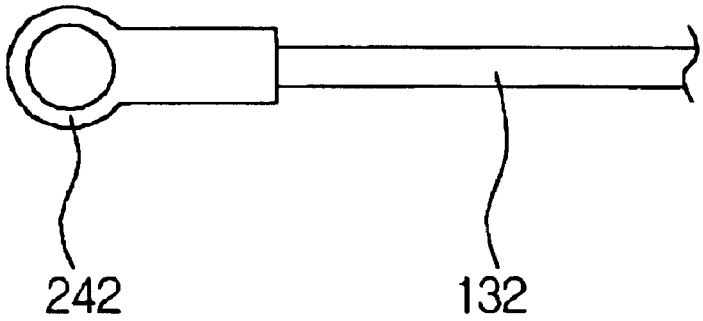
FIG. 13 is a partial view illustrating a holding cap for a proximal end of a rear frame rod of the main wing of the ornithopter shown in FIG. 1.

FIG. 13 shows a holding cap 242 formed at the proximal end of the rear frame rod 132 of the main wing 120. The holding cap 242 is constructed in such a manner that an opening of the holding cap is formed by cutting away a portion of an envelope of a hollow spherical body having an inner diameter slightly larger than the diameter of the holding ball 254. The diameter of the opening of the holding cap is determined to be slightly smaller than that of the holding ball 254. If the holding cap 242 is molded with resin materials that is elastically deformable within a small range, the holding ball 254 can be press-fitted into the holding cap 242 through the opening thereof. Since the opening of the holding cap 242 is elastically restored after the holding ball 254 is pushed into and resides in the holding cap 242, the holding ball 254 hardly escapes from the holding cap 242 and the rear frame rod 132 of the main wing 120 extending from the holding cap 242 can freely pivot in 3-axis directions on the holding ball 254.

Figure 14:
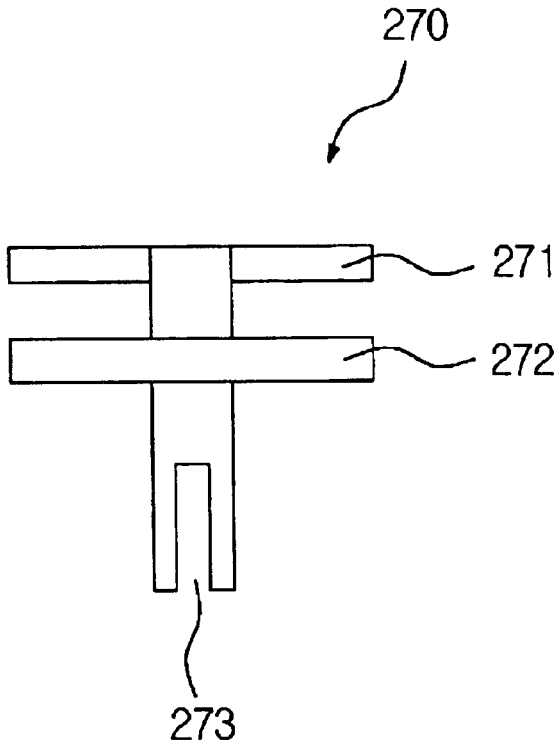
FIG. 14 is a plan view illustrating a tail wing supporting holder mounted on a rear end of the keel panel of the ornithopter shown in FIG. 1.
Figure 15:
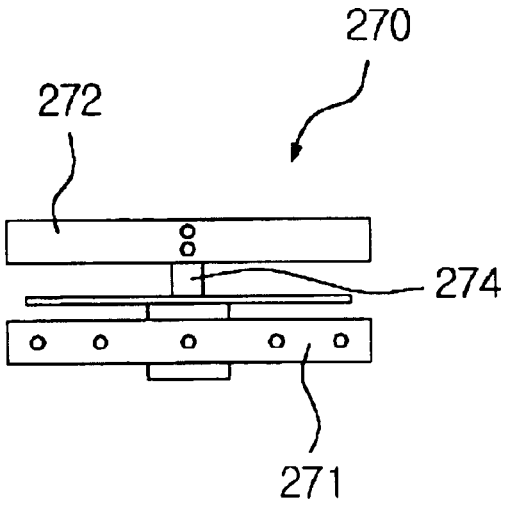
FIG. 15 is a front view of the tail wing supporting holder shown in FIG. 14.

FIGS. 14 and 15 show a tail wing support 270 mounted on the rear end of the keel panel 210 according to the embodiment. The tail wing support 270 includes a horizontal tail support 271 for supporting the horizontal tail 170 and a vertical tail support 272 for supporting the vertical tail 180. The horizontal tail support 271 is provided with a slit 273 into which the rear end of the keel panel 210 can be inserted. After the rear end of the keel panel 210 is inserted into the slit 273, a fixing pin (not shown) penetrates therethrough so that the horizontal tail support 271 can be swung on the fixing pin in the up and down direction. The vertical tail support 272 is constructed to be supported by a pivot shaft 274 disposed on the central axis of the body 110 and to be pivoted in a lateral direction on the pivot shaft.

As shown in FIG. 7, one or more switches are installed on the keel panel 210 for controlling supply of the electric power from the battery 222 to the electric motor 221. Two electrical switches are installed thereon in this embodiment. A first switch 223 is installed at a lower portion of a rear section of the keel panel 210, and a second switch 224 is installed at a lower end of a front section of the keel panel 210. The first and second switches 223, 224 are connected to the electric motor 221 in series so that the electric power can be supplied to the electric motor 221 only when both the first and second switches 223, 224 are turned on. The first switch 223 is a switch constructed to be turned on and off according to selection by a user. The second switch 224 is a switch constructed such that it is always turned on when a switching knob is free and turned off only when the switching knob is pressed by external force.

The second switch 224 installed at the lower end of the front section of the keel panel 210 is constructed to be turned off when the ornithopter is landed. Instead of a push on/off switch that is turned off only when the switching knob is pressed by the external force, the second switch 224 may be a timer switch, which can be automatically turned off when a predetermined time elapses, or a remote control switch, which can be turned on and off by signals radio-transmitted from a controller. At this time, the timer switch or remote control switch may simultaneously have the function of the first switch as a main switch for controlling the supply of the electric power.

A mechanical or electronic timer may be employed as the timer switch. Since the mechanical or electronic timer is easily available from the market, the detailed description thereof will be omitted herein.

As shown in FIG. 3, the housing 111, 112 of the body 110 is constructed such that an extra space is formed between a front end of the housing 111, 112 and a front end of the power transmission mechanism 230 to extend from a front end of the electric motor 221 and the power transmission mechanism 230, which are mounted at a front end of the keel panel 210, to a position forward spaced apart therefrom. The extra space is filled with a shock absorbing material 113.

As shown in FIG. 1, in a state where the housing 111, 112 is assembled around the keel panel 210, the main wing 120 is exposed to the outside of the housing 111, 112 so that the flapping thereof can be freely made. Further, the horizontal tail 170 is exposed to the outside of the housing so that a vertical swing angle thereof can be controlled, and the vertical tail 180 is also exposed to the outside of the housing so that a horizontal swing angle thereof can be controlled. In the meantime, the switching knob of the first switch 223 disposed at the lower portion of the rear section of the body 110 is exposed to the outside of the housing 111, 112. A pusher 114 capable of pressing the switching knob of the second switch 224 protrudes beyond an outer surface of the housing 111, 112 at the lower portion of the body 110. When the ornithopter 100 according to the present invention is landed and then the lower portion of the body 110 comes into contact with the ground, the pusher 114 is pushed into the housing and then presses the switching knob of the second switch 224 to turn off the second switch 224. If the ornithopter 100 is lifted from the ground, the pusher 114 is restored to the protruding position and thus the switching knob of the second switch 224 becomes free so as to turn on the second switch 224.

The lightweight and high capacity battery 222 such as a lithium battery is mounted into the battery mounting hole 214 of the keel panel 210 in such a manner that charging terminals thereof can be exposed to the outside of the housing 111, 112.

Hereinafter, the operation of the ornithopter 100 according to the embodiment will be described.

When the user grips the body 110 and turns on the first switch 223, the electric motor 221 is driven and thus the left and right main wings 121, 122 flap in the up and down direction. The force generating the flapping is transmitted from the electric motor 221 through the power transmission mechanism 230 to the front frame rods 131 of the left and right main wings 121, 122. Therefore, as the front frame rods 131 moves from an upper position to a lower position or from the lower position to the upper positions, the other portions of the left and right main wings 121, 122 move while following the front edge 123. When the main wing 120 performs the down motion, that is, moves from the upper position to the lower position, a bottom surface of the main wing 120 is subjected to air resistance. Since the initiative front edge 123 is followed by the rear edge 124, the main wing 120 moves in a state where the rear edge 124 is slightly raised as compared with the front edge 123.

On the other hand, when the main wing 120 performs the up motion, that is, moves from the lower position to the upper position, a top surface of the main wing 120 is subjected to air resistance. Since the initiative front edge 123 is followed by the rear edge 124, the main wing 120 moves in a state where the rear edge 124 is slightly lowered as compared with the front edge.

The motion of the main wing generate an air stream with which air flows backward along the body in the same manner as the fanning action, and the thrust is obtained as a reaction force produced by the air stream. At this time, respective directions of the reaction force when the main wing performs the up motion and the down motion are slanted with respect to the central axis of the body and are symmetric to each other. Therefore, as for the reaction force obtained when the main wing flaps once, i.e. the reaction force obtained from the up and down reciprocating motion, a component of the reaction force perpendicular to the central axis of the body is canceled due to interference with each other, and only a force component which is directed forward of the body and parallel to the central axis of the body remains.

When the body is in a horizontal attitude, such parallel reaction force serves only as the thrust for forward flying of the body. However, if the horizontal tail is kept in a state where it is not horizontal but raised, a nose of the ornithopter is raised due to a reaction force to which the horizontal tail is subjected by the forward flying of the ornithopter. In a state where the nose of the ornithopter is raised, a vertical component of the parallel reaction force serves as the lift for causing the ornithopter to climb and only a horizontal component of the parallel reaction force serves as the thrust.

Meanwhile, when the ornithopter advances in a horizontal or gliding direction in the state where the nose thereof is raised, the body and main wing have a slant attack angle with respect to a direction of a relative wind, which flows, along the vicinity of the body and main wing due to the advancement of the ornithopter. The attack angle has an influence on the direction and magnitude of a drag exerted on the body and main wing by the relative wind. A vertical component of the drag serves as the lift for the body and main wing, whereas a horizontal component of the drag acts in a direction opposite to that of the thrust.

By controlling the vertical swing angle of the horizontal tail, the magnitude of the attack angle corresponding to the raised degree of the nose of the ornithopter is adjusted. Consequently, the lift is adjusted, and thus, the ornithopter can climb or descend.

The nose of the ornithopter according to the present invention is raised and then the lift is generated when the ornithopter advances. That is, if an advancement speed of the ornithopter is zero and the ornithopter takes the horizontal attitude, the lift is hardly generated and thus the ornithopter cannot make a takeoff. Therefore, the ornithopter requires wheels for allowing the ornithopter to run on the ground until it reaches a proper speed. However, the ornithopter of the illustrated embodiment is not provided with the wheels in order to reduce its weight. In order to fly the ornithopter having no wheels, the ornithopter should be moved to and released at a predetermined or higher level. When the ornithopter is released to fly through the air, it flies forward while descending due to the insufficient lift. Then, if the advancement speed and the lift in response thereto become sufficient, the ornithopter flies while adjusting its flight altitude depending on the vertical swing angle of the horizontal tail. A most preferred method of flying the ornithopter having the wheels is to slightly throw the ornithopter forward and upward at an angle of about 10° with respect to a horizontal plane in a state where the nose thereof is slightly raised from its horizontal attitude.

Meanwhile, in a case where the vertical tail 180 is provided as shown in the preferred embodiment of the present invention, a straight flight of the ornithopter can be made by aligning the vertical tail 180 in the same direction as the central axis of the body 110. Further, left and right turns of the ornithopter can be made by deflecting the vertical tail 180 to the left and right, respectively.

When the ornithopter 100 flies and then lands on the ground, the pusher 114 protruding from the bottom surface of the body 110 is pressed against the ground and thus the second switch 224 is turned off. Thus, the electric motor 221 is stopped, and at the same time, the flapping of the main wing 120 is stopped.

If the user grasps a long and lightweight string attached to a lower portion of the body 10, the ornithopter 100 is forcibly centrifugally turned around by a traction force of the string. Alternatively, if the ornithopter 100 is flown with the length of the string shortened and the vertical tail 180 deflected, the ornithopter 100 turns around above the user's head in a state where the string hangs down loose from the ornithopter. In order to stop flying the ornithopter, the user simply pulls down the grasped string.

If the ornithopter 100 collides against the ground or other objects during its landing or flight, the body thereof may be damaged. Since the main wing 120, the tail wing 170, 180 and the housing 111, 112 of the ornithopter 100 according to the embodiment are constructed to be easily assembled and disassembled, they can be easily replaced with new ones upon damage thereof. Further, even though the nose of the ornithopter 100 collides against the ground or the other objects and thus the front portion of the housing 111, 112 are damaged, the shock absorbing material 113 filled into the extra space at the front portion of the housing 111, 112 of the body 100 prevents the keel panel 210 and the power transmission mechanism 230 mounted thereon from being damaged. Moreover, even though the damage has an influence on the keel panel 210 and the power transmission mechanism 230 and thus the support 213 extending from the lower portion of the front end of the keel panel 210 is broken, the assembly of the electric motor 221 and the power transmission mechanism 230 are not damaged.

Figure 16:
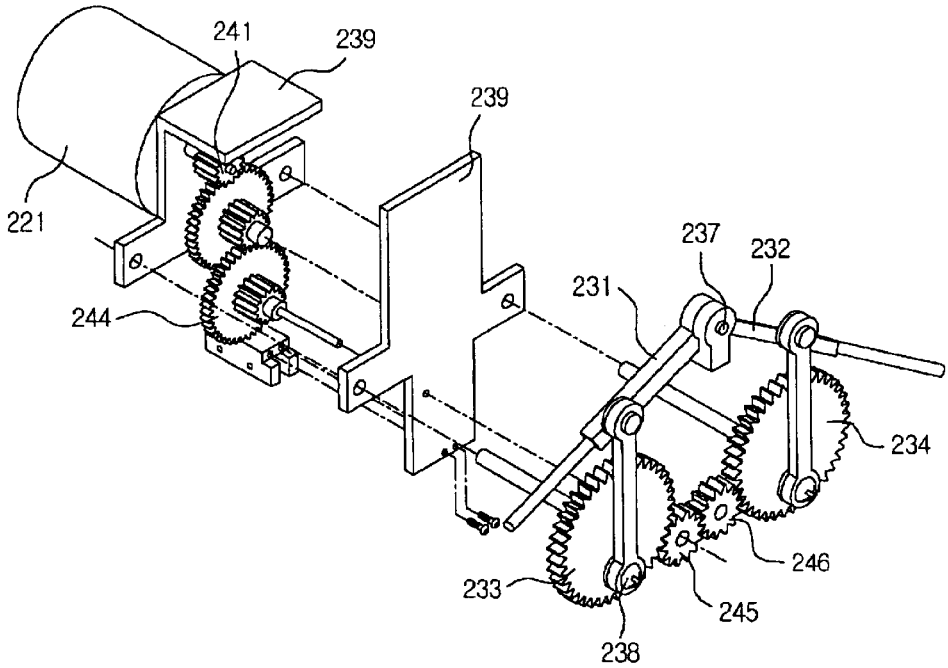
FIG. 16 is an exploded view illustrating an assembly of an electric motor and a power transmission mechanism according to another embodiment of the present invention.

FIG. 16 shows the power transmission mechanism 230 of the ornithopter 100 according to another preferred embodiment of the present invention.

The power transmission mechanism 230 according to this embodiment includes a further power transmission geared-wheel, in addition to the pair of driven wheels 233, 234 and the five additional intermediate power transmission geared-wheels of the power transmission mechanism 230 shown in FIG. 10. As shown in the figure, the further power transmission geared-wheel is formed with an eighth external gear 246 having the same number of teeth as the fifth external gear of the fifth power transmission geared-wheel 245. The eighth external gear 246 is interposed between and engaged with the fifth and seventh external gears. The eighth external gear 246 rotates in a direction, which is opposite to that of the fifth external gear but identical with that of the sixth external gear, at the same speed as the fifth external gear. The seventh external gear engaged with the eighth external gear 246 rotates in a direction opposite to that of the sixth external gear at the same speed as the sixth external gear. In the aforementioned power transmission mechanism 230 shown in FIG. 10, since the sixth and seventh external gears and thence the pair of driven wheels 233, 234 rotate in the same direction, the pair of connecting rods 235, 236 move asymmetrically with respect to the central axis. Thus, even though the swing motions of the pair of arms 231, 232 simultaneously reach the uppermost and lowermost positions, speeds at intermediate positions between the uppermost and lowermost positions of the arms are different from each other. However, in the power transmission mechanism 230 according to this embodiment, the rotational speeds of the pair of driven wheels 233, 234 are identical with each other and the pair of connecting rods 235, 236 symmetrically move with respect to the central axis. Therefore, the swing motions of the pair of arms 231, 232 simultaneously reach the uppermost and lowermost positions and the speeds at the intermediate positions between the uppermost and lowermost positions of the arms are also identical with each other.

Figure 17:
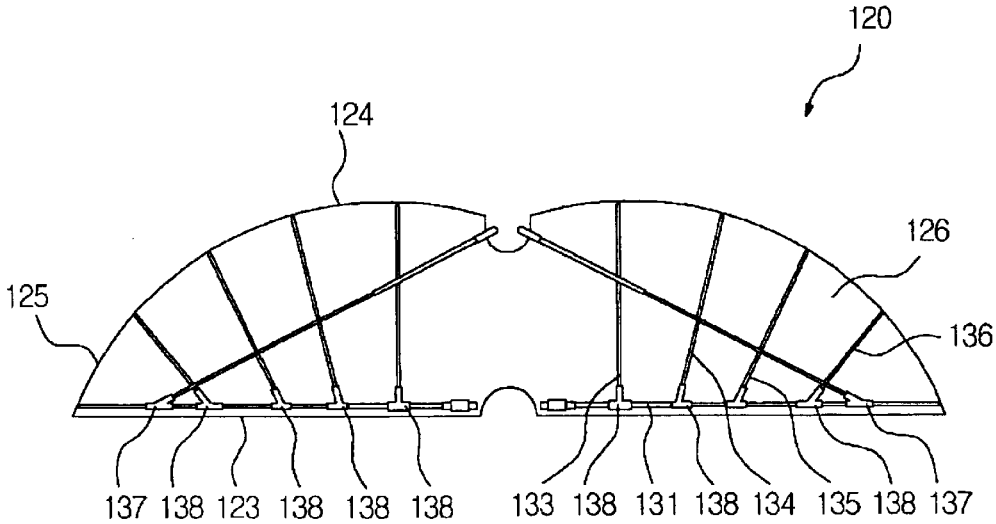
FIG. 17 is a deployment view illustrating a main wing according to a further embodiment of the present invention.

FIG. 17 shows the constitution of the main wing 120 according to another embodiment of the present invention.

Each of the left and right main wings 121, 122 of the main wing 120 according to the previous embodiment shown in FIG. 2 includes the three traverse frame rods 133, 134 and 135, whereas each of the left and right main wings 121, 122 of the main wing 120 according to this embodiment includes four traverse frame rods 133, 134, 135 and 136. The main wing 120 according to this embodiment is identical with the main wing 120 according to the previous embodiment in view of their constitutions and operations except for different outlines of the skin 126 thereof. In the main wing 120 according to this embodiment, the front end of the first traverse frame rod 133 is located at a position spaced apart by 1/10 to 3/10 of the full length of the front frame rod 131 from the proximal end of the front frame rod 131. The front end of the second traverse frame rod 134 is located at a position spaced apart by 3/10 to 4/10 of the full length of the front frame rod 131 from the proximal end of the front frame rod 131. The front end of the third traverse frame rod 135 is located at a position spaced apart by 4/10 to 5/10 of the full length of the front frame rod 131 from the proximal end of the front frame rod 131. A front end of the fourth traverse frame rod 136 is located at a position spaced apart by 5/10 to 7/10 of the fill length of the front frame rod 131 from the proximal end of the front frame rod 131. The traverse frame rods 133, 134, 135 and 136 are disposed in such a manner that they are further spaced apart from the central axis of the body 110 when proceeding from their front ends to their rear ends. As for angles formed between the central axis of the body 110 and the lengths of the respective traverse fame rods 133, 134, 135 and 136, the angles are about 0 to 5° in case of the first traverse frame rod 133, about 5 to 30° in case of the second traverse frame rod 134, about 30 to 50° in case of the third traverse frame rod 135, and about 50 to 70° in case of the fourth traverse frame rod 136, respectively.

Although the ornithopter of the aforementioned preferred embodiments of the present invention has been described as including both the horizontal and vertical tails, the vertical tail may be omitted and the horizontal tail may be constructed to be able to control the vertical swing angle as well as to swing horizontally within a predetermined angular range about a rotational axis parallel to the central axis of the body so that the climbing, descending and turning of the ornithopter can be controlled only by the horizontal tail.

The ornithopter 100 of the present invention can be manufactured in a relatively simple and inexpensive manner. The ornithopter is lightweight and can obtain a great lift even at a low flying speed in which energy consumption is low. Therefore, longer flight can be made after the battery is once charged. There is less possibility of damage to major components of the ornithopter upon collision thereof against the ground or the other objects. Since only damaged components can be easily replaced with new ones, maintenance costs can be reduced.

Heretofore, the ornithopter of the present invention has been described with reference to the preferred embodiments thereof. However, they are merely examples of the present invention and do not intend to limit the present invention. It will be apparent to those skilled in the art that various modifications, changes or adjustments can be made thereto without departing from the technical spirit and scope of the invention. Therefore, the appended claims intend to include such various modifications, changes or adjustments.

What is claimed is:

1. An ornithopter comprising a body, a main wing attached to an upper portion of a front section of the body, a tail wing attached to a rear section of the body, a power source and a power transmission mechanism installed within a housing of the body, wherein:

the main wing includes a wing frame composed of a plurality of frame rods and a skin attached to the wing frame for forming an outline of the main wing;

the wing frame of the main wing is supported by a support means exposed to the outside at the upper portion of the front section of the body; and the power transmission mechanism includes a gear train for adjusting the rotational motion of the power source at a proper speed and transferring it to the main wing, and connecting rods for converting the rotational motion into a swing motion of the main wing.

2. The ornithopter as claimed in claim 1, wherein the tail wing is a horizontal tail constructed to be able to control a vertical swing angle thereof as well as to swing horizontally within a predetermined angular range on a rotational axis parallel to a central axis of the body.

3. The ornithopter as claimed in claim 1, wherein the tail wing includes a single horizontal tail and a single vertical tail.

4. The ornithopter as claimed in claim 1, wherein the body is enclosed by the housing composed of two members, left and right halves.

5. The ornithopter as claimed in claim 4, wherein engagement portions of the left and right halves of the housing are provided with sawteeth;

bonding portions to which bonding tapes have been applied are provided at and around the sawteeth of the left and right halves of the housing; and an additional adhesive tape is applied onto the bonding portions of the bonding tapes in a state where the left and right halves are coupled with each other.

6. The ornithopter as claimed in claim 4, wherein the body includes a keel made of a lightweight and rigid unitary panel.

7. The ornithopter as claimed in claim 6, wherein the power source is an electric motor mounted at an upper front end of the keel panel, and the power transmission mechanism is mounted in front of the electric motor.

8. The ornithopter as claimed in claim 1, wherein a front edge of the main wing is formed in the shape of a straight line, and a rear edge and tips of the main wing are composed of smoothly connected curves; and the main wing is composed of left and right main wings which are formed integrally with each other and symmetric to each other with respect to a central axis of the body.

9. The ornithopter as claimed in claim 8, wherein each of the left and right main wings includes a single front frame rod, a single rear frame rod, and a plurality of traverse frame rods.

10. The ornithopter as claimed in claim 9, wherein the number of the traverse frame rods is three.

11. The ornithopter as claimed in claim 9, wherein the number of the traverse frame rods is four.

12. The ornithopter as claimed in claim 9, wherein an axial bore is formed at a proximal end of each front frame rod of the main wing;

the axial bore is connected to one of arms that performs a swing motion on a pivotal point;

a holding cap is formed at a proximal end of each rear frame rod of the main wing; and the holding cap is capped on one of holding balls exposed to the outside at the rear section of the body.

13. The ornithopter as claimed in claim 12, wherein the gear train of the power transmission mechanism is a reduction gear train which is engaged with a rotating shaft of the electric motor and a pair of driven wheels and reduces and simultaneously transfers the rotational motion of the electric motor to the pair of driven wheels;

a final power transmission geared-wheel of the reduction gear train is engaged with the pair of driven wheels; and each connecting rod is supported at its one end by a supporting pole protruding from a position of the relevant arm spaced apart from the pivotal point of the arms, and is supported at the other end by a supporting pole protruding from a position near the circumference of the driven wheel.

14. The ornithopter as claimed in claim 13, wherein the supporting pole on the left driven wheel and the supporting pole on the right driven wheel are installed to be in the same phase.

15. The ornithopter as claimed in claim 7, further comprising two switches for controlling supply of electric power from a battery to the electric motor;

wherein a first switch is installed to be exposed to the outside at a lower portion of the rear section of the body;

a second switch is constructed to be turned off when a pusher installed at a lower end of the body is pressed; and the first and second switches are connected to the electric motor in series so that the electric power can be supplied to the electric motor only when both the first and second switches are turned on.

16. The ornithopter as claimed in claim 7, further comprising a switch for controlling supply of electric power from a battery to the electric motor, wherein the switch is a timer switch that can be automatically turned off when a predetermined time elapses after it is turned on.

17. The ornithopter as claimed in claim 7, further comprising a switch for controlling supply of electric power from a battery to the electric motor, wherein the switch is a remote control switch that can be turned on and off by signals radio-transmitted from a controller.

18. The ornithopter as claimed in claim 7, wherein the housing of the body is constructed such that an extra space is formed between a front end of the housing and a front end of the power transmission mechanism to extend from the front end of the electric motor and the power transmission mechanism, which are mounted at the front end of the keel panel, to a position forward spaced apart therefrom, and the extra space is filled with a shock absorbing material.

19. The ornithopter as claimed in claim 14, wherein the power transmission mechanism further includes another power transmission geared-wheel which has the same number of teeth as the final power transmission geared-wheel of the reduction gear train and is engaged with the final power transmission geared-wheel;

a left driven wheel of the pair of driven wheels is engaged with the final power transmission geared-wheel; and a right driven wheel of the pair of driven wheels is engaged with the another power transmission geared-wheel.

20. The ornithopter as claimed in claim 12, wherein the frame rods are made of rigid and tough alloy materials or carbon materials capable of maintaining their initial shapes.

21. The ornithopter as claimed in claim 20, wherein each front frame rod extends along a front edge of the main wing from a position near a central axis of the body to a tip of the main wing and is initially formed in the shape of a straight line;

each rear frame rod extends from a position near an intersection where the central axis of the body meets a rear edge of the main wing and is connected to the front frame rod near an end of the tip of the main wing and thence to a distal end of the front frame rod; and respective traverse frame rods extend from the front frame rod to the rear edge of the main wing.

22. The ornithopter as claimed in claim 21, wherein a front end of a first traverse frame rod is located at a position spaced apart by 1/10 to 3/10 of the full length of the front frame rod from a proximal end of the front frame rod;

a front end of a second traverse frame rod is located at a position spaced apart by 3/10 to 5/10 of the full length of the front frame rod from the proximal end of the front frame rod;

a front end of a third traverse frame rod is located at a position spaced apart by 5/10 to 8/10 of the full length of the front frame rod from the proximal end of the front frame rod; and the traverse frame rods are disposed in such a manner that they are further spaced apart from the central axis of the body when proceeding from their front ends to their rear ends.

23. The ornithopter as claimed in claim 21, wherein a front end of a first traverse frame rod is located at a position spaced apart by 1/10 to 3/10 of the full length of the front frame rod from a proximal end of the front frame rod;

a front end of a second traverse frame rod is located at a position spaced apart by 3/10 to 4/10 of the full length of the front frame rod from the proximal end of the front frame rod;

a front end of a third traverse frame rod is located at a position spaced apart by 4/10 to 5/10 of the full length of the front frame rod from the proximal end of the front frame rod;

a front end of a fourth traverse frame rod is located at a position spaced apart by 5/10 to 7/10 of the full length of the front frame rod from the proximal end of the front frame rod; and the traverse frame rods are disposed in such a manner that they are further spaced apart from the central axis of the body when proceeding from their front ends to their rear ends.

24. The ornithopter as claimed in claim 22, wherein and the length of the first traverse frame rod is at an angle of about 10 to 30°, the length of the second traverse frame rod is at an angle of about 30 to 50°, and the length of the third traverse frame rod is at an angle of about 50 to 70°, with respect to the central axis of the body.

25. The ornithopter as claimed in claim 23, wherein and the length of the first traverse frame rod is at an angle of about 0 to 5°, the length of the second traverse frame rod is at an angle of about 5 to 30°, the length of the third traverse frame rod is at an angle of about 30 to 50°, and the length of the fourth traverse frame rod is at an angle of about 50 to 70°, with respect to the central axis of the body.

26. The ornithopter as claimed in claim 20, wherein the skin is made of a sheet that is lightweight, lacks elasticity, and is high waterproof and durable.

27. The ornithopter as claimed in claim 7, wherein protrusions for supporting the electric motor are formed at the upper front end of the keel panel;

a lower front end of the keel panel extends further forward as compared with the upper front end thereof to form a support for supporting the power transmission mechanism;

the protrusions are inserted into holes formed at a rear surface of the power the electric motor with play in such a degree that the protrusions can easily escape from the holes; and the power transmission mechanism is fixed to the support by means of screws.

* * * * *